US005337637A

United States Patent [19]

Bih-Lien

[11] Patent Number: 5,337,637

[45] Date of Patent: Aug. 16, 1994

[54] SCREWDRIVER WITH REPLACEABLE DRIVER BITS

[76] Inventor: Chen L. Bih-Lien, No. 14, Alley 86, Lane 412, Chen-Hsing Road, Taichung, Taiwan

[21] Appl. No.: 91,353

[22] Filed: Jul. 14, 1993

[51] Int. Cl.[5] ..... B25B 23/00; B25G 1/08

[52] U.S. Cl. ..... 81/439; 81/177.4

[58] Field of Search ..... 81/437, 438, 439, 124.4, 81/124.5, 177.4, 490

[56] References Cited

U.S. PATENT DOCUMENTS

| | | | |
|---|---|---|---|
| 1,579,498 | 4/1926 | Anderson | 81/439 |
| 3,750,729 | 8/1973 | Lemieux | 81/439 |
| 4,976,175 | 12/1990 | Hung | 81/439 |

*Primary Examiner*—D. S. Meislin
*Attorney, Agent, or Firm*—Ladas & Parry

[57] ABSTRACT

An improved screwdriver comprises a hollow cylinder having a plurality of guiding slots therein, each guiding slot receiving a slidable connecting piece having one end connected to a driver bit; a hollow guiding cylinder having a plurality of sliding slots therein is connected to one end of the hollow cylinder, the sliding slots corresponding to the guiding slots in the hollow cylinder for receiving the driver bits; a positioning head is connected to the other end of the hollow guiding cylinder and has an exit end with a hole of the size of the driver bits; a hollow sealing cover is connected to the other end of the hollow cylinder; and an actuator rod is slidably mounted within the sealing cover, and a peg is provided at the center of the actuating rod. An engaging piece is engageable at the outside of the sealing cover such that by rotating and pressing down the actuating rod, the peg is caused to contact any selected connecting piece, so that different sizes and shapes of driver bits can be extended from the positioning head as desired.

15 Claims, 3 Drawing Sheets

SCREWDRIVER WITH REPLACEABLE DRIVER BITS

BACKGROUND OF THE INVENTION

The present invention relates to an improved screwdriver, in particular, to a screwdriver having a plurality of driver bits which can be replaced and thus the screwdriver can be conveniently used as desired. When operating the screwdriver, a actuating rod is operated so cause one of the driver bits protruding from the exiting end of the screwdriver.

When turning and driving screws, one often makes use of several screwdrivers to fit different-sized screws. As a result, it is not convenient to use these screwdrivers for the reason that some of the required screwdrivers may not be easily available, particularly precision screwdrivers. In order to overcome such a shortcoming, these screwdrivers may be orderly arranged in a storage case to avoid misplacing of the screwdrivers. However, it is rather inconvenient to carry the storage case along when using the screwdriver.

SUMMARY OF THE INVENTION

Therefore, it is an object of the present invention to provide an improved screwdriver comprising a hollow cylinder adaptable to a plurality of connecting pieces, wherein these pieces are elastically slidable, and one end of the hollow cylinder is connected to a hollow guiding cylinder which is constructed for the accommodation of a plurality of driver bits; a positioning head having an exiting end with a hole of a size similar to the cross-sectional area of the driver bit being connected to the other end of the hollow guiding cylinder; actuating rod being slidable within the hollow cylinder, and by means of a peg on the actuating rod acting on the connecting piece, the driver bit is extended outwards from the positioning head for operation. Thus, the screwdriver in accordance with the present invention provides rapid selection of driver bits as desired and also for convenient operation.

Another object of the present invention is to provide an improved screwdriver, wherein the top edge of the hollow cylinder is provided with a sealing cover, and the actuating rod is movable along the sealing cover; an engaging piece is inserted at the outside of the sealing cover so as to form engagement with the actuating rod. When the actuating rod is pressed and the driver bit is caused to protrude outward, the pressing level is positioned by means of the engaging piece; when the engaging piece is pressed downward, the pressing level is disengaged from the engagement position by means of the spring force of the connecting piece, the pressing level is restored to its original position.

These and other objects, advantages and features of the present invention will be more fully understood and appreciated by reference to the written specification.

DETAILED DESCRIPTION OF THE INVENTION

Figure 1:
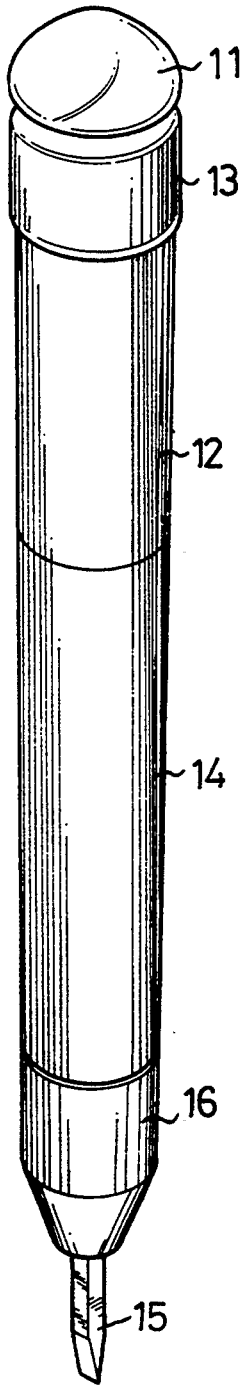
FIG. 1 is a perspective view of the screwdriver according to the present invention.
Figure 2:
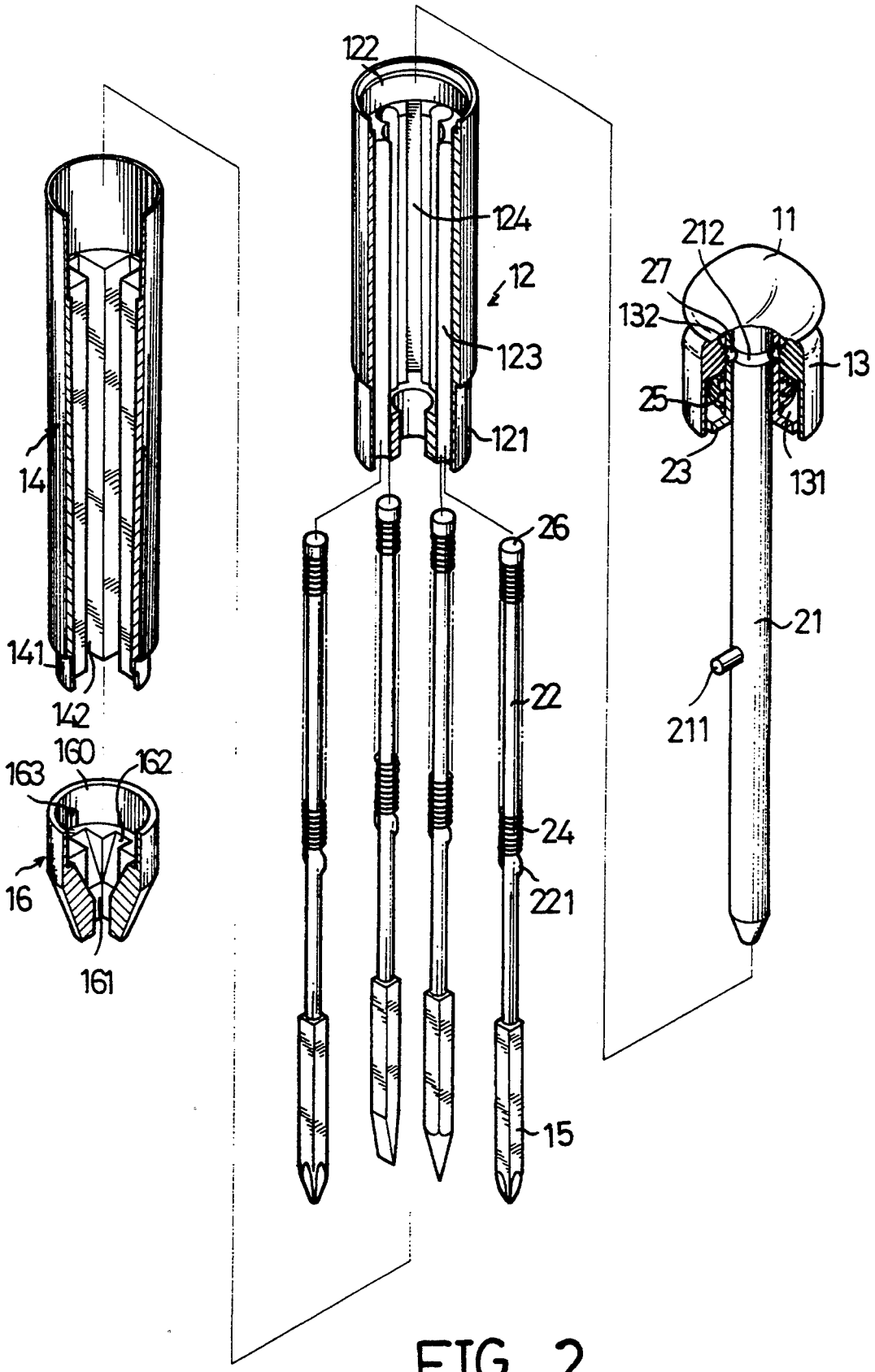
FIG. 2 is the screwdriver of the perspective, exploded view of the present invention.

Referring to FIGS. 1 through 4, in particular to FIGS. 1 and 2, there is shown a screwdriver comprising a hollow cylinder 12 having a plurality of guiding slots 123 within the hollow cylinder 12, wherein, between two guiding slots 123, a channel 124 is provided. Each of the guiding slots 123 receives a slidable connecting piece 22. One end of each connecting piece 22 is surmounted by a blocking piece 26, and the other end is connected to a driver bit 15. The driver bits 15 are of different sizes and shapes. At a position approximately at the center of the connecting piece 22, a pair of lugs 221 are provided and a spring 24 is mounted around the outer surface of the connecting piece 22 between the lugs 221 and the blocking piece 26 such that the connecting piece 22 is elastically slidable in the associated slot in the cylinder. One end of the hollow cylinder 12 has a step-like notch 122 and the other end is a step-like engaging end 121. When the connecting piece 22 is mounted on the guiding slot 123, the lugs 221 engage the guiding slot 123 at the external edge of the engaging end 121 in order to block the upward moment of the connecting piece 22, and the bottom end of the spring 24 is restricted within the guiding slot 123 from extending outward so as to keep the elasticity of the connecting piece 22.

A hollow guiding cylinder 14 is inserted into the hollow cylinder 12 at the engaging end 121 thereof. The other end of the hollow guiding cylinder 14 is a step-like engaging end 141. The inner wall of the hollow guiding cylinder 14 is provided with a plurality of sliding slots 142 corresponding to the guiding slots 123 of the hollow cylinder 12. The cross-section of the sliding slot 142 is adaptable to the driver bit 15 and also allows the sliding of the driver bit 15 within the sliding slot 142.

A positioning head 16 is substantially a conic shape. The end with larger external diameter is provided with a notch 160 for combination with the engaging end 141 of the hollow guiding cylinder 14. The inner wall of the positioning head 16 is provided with a plurality of tapered sliding slots 162 which are correspond to the sliding slots 142 of the hollow guiding cylinder 14. The inner wall of the other end of the positioning head 16 is provided with a positioning hole 161 of appropriate size. The configuration of the hole 161 corresponds to that of the driver bit 15. The notch 160 of the positioning head 16 is provided with a pair of ribs 163 and the engaging end 141 of the hollow guiding cylinder 14 corresponds to the position of the ribs 163. In other word, notches (not shown) are provided individually for the ribs 163 for the positioning of the positioning head 16 with the hollow guiding cylinder 14. The individual slots 162 and 142 should be aligned in order to allow the driver bit to be extended.

A hollow sealing cover 23 is mounted at the step-like notch 122 of the hollow cylinder 12. The hollow cylinder 12 and a bottom of the sealing cover 23 form a space therebetween. The outside of the sealing cover 23 is inserted in a movable engaging piece 13. The bottom of the engaging piece 13 has a recess 131 for a spring 25, such that the engaging piece 13 is elastically slidable with respect to the sealing cover 23.

An actuating rod 21, one end being connected to a 10 pressing block 11, is provided within the sealing cover 23. A peg 211 is provided in a center region of the actuating rod. A circular groove 212 is provided in the rod 21 near the pressing block 11. When the screwdriver is not used, the peg 211 is engaged within the channel 124 of the hollow cylinder 12. At this time, the driver bit 15 can be engaged within the hollow guiding cylinder 14. A groove 132 is provided in the engaging piece 13 and (FIG. 4) is arch-shaped. In addition, a plurality of holes 231 are provided on the sealing cover 23 near the top end thereof. The holes 231 are respectively provided with balls 27, the diameter of each of which is slightly larger than the depth of the hole 231.

Figure 3:
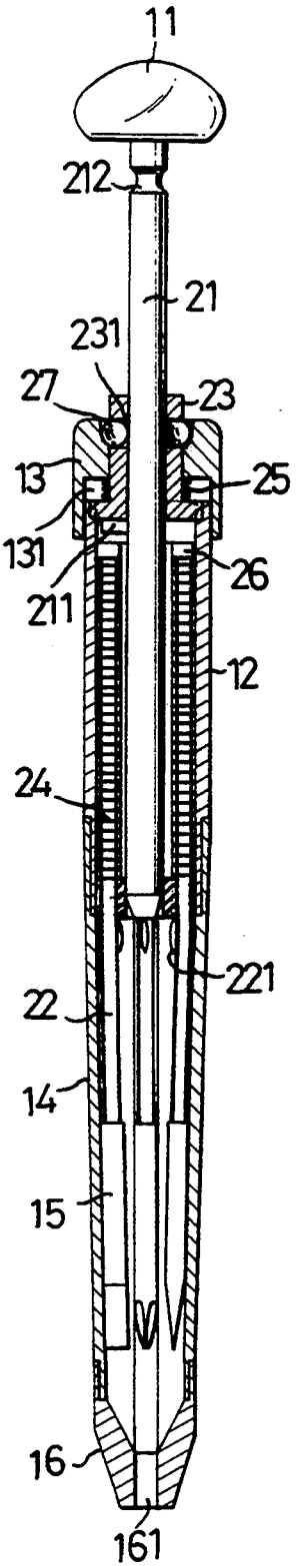
FIG. 3 is a cross-section view, showing the actuating rod when not pressed.
Figure 4:
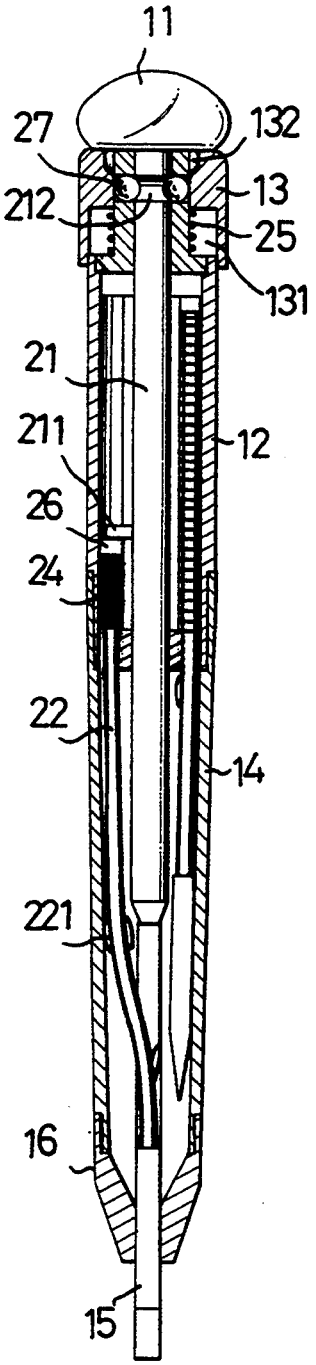
FIG. 4 is a cross-section view, showing the actuating rod being pressed and the driver bit when extended, wherein the actuating rod when in engagement with the engaging piece.

Referring to FIG. 3, when using the screwdriver, the actuating rod is extended out of the sealing cover 23. As a result of the urging of the actuating rod 21, the balls 27 will partially protrude out of the holes 231 and fear against the groove 132 in the engaging piece 13. At this time, the spring 25 is in a compressed state. Due to the fact that the groove 132 in the engaging piece 13 is compressed, the engaging piece 13 will be blocked by the balls 27 and will not move upward. The peg 211, which is in the space between the notch 122 and the bottom of the hollow cover 23, can change its position within the space by rotating the pressing block 11 to provide the selection of the driver bit 15. When the pressing block 11 is then downwards pressed, the peg 211 of the actuating rod 21 will act on the blocking piece 26 and press the connecting piece 22 downwards and force the driver bit 15 to protrude out of the positioning head 16 until the circular groove 212 in the actuating rod 21 reaches the balls 27. Due to the spring force of the spring 25, the engaging piece 13 will move upward to cause the balls 27 to move inwards and engage in the circular groove 212. Thus, the actuating rod 21 is positioned, as shown in FIG. 4. At this time, the user can operate the driver bit 15 conveniently. If the driver bit 15 is to be retracted, the balls 27 are dislocated from their engagement with the actuating rod 21 and moved into the groove 132 of the engaging piece 13. The actuating rod 21 is pressed by the spring 24, i.e. the upward spring force, the driver bit 15 is retracted and kept within the hollow guiding cylinder 14, as is shown in FIG. 3. In accordance with the requirement of the operator, the actuating rod 21 can be rotated to select another driver bit or to insert the peg 211 into the channel 124 for easy storage.

It is apparent that although the invention has been described in connection with a preferred embodiment, those skilled in the art may make changes to certain features of the preferred embodiment without departing from the spirit and scope of the invention as defined in the appended claims.

I claim:

1. A screwdriver with replaceable driver bits comprising:

a hollow cylinder having a plurality of guiding slots therein;

a plurality of connecting pieces having respective ends connected to respective driver bits and being slidably received in said guiding slots;

a hollow guiding cylinder having a plurality of sliding slots therein and having one end connected to said hollow cylinder with said sliding slots in the guiding cylinder. corresponding to said guiding slots in said hollow cylinder for receiving said driver bits;

a positioning head connected to said hollow guiding cylinder at the other end thereof, said positioning head having an exit end with a hole thereon for travel of a selected driver bit therethrough;

a hollow sealing cover connected to the other end of said hollow cylinder;

an actuating rod slidably mounted within said sealing cover, and a peg provided at the center of said actuating rod; and an engaging piece movably engaged externally on said sealing cover;

whereby pressing said actuating rod downwardly causes said peg to contact a selected said connecting piece causing the driver bit corresponding to the selected connected piece to travel through the hole in said positioning head and protrude out of said positioning head.

2. The screwdriver as claimed in claim 1, wherein each connecting piece includes a blocking piece at one end thereof and a pair of lugs at the center of said connecting piece, and a spring is mounted along said connecting piece between said lugs and said blocking piece.

3. The screwdriver as claimed in claim 1, wherein said positioning head is provided with a plurality of tapered sliding slots therein corresponding to said sliding slots in said guiding cylinder.

4. The screwdriver as claimed in claim 3, wherein said positioning head is provided with a pair of ribs adjacent to said tapered sliding slots, and said hollow guiding cylinder has a pair of notches corresponding to said ribs at the other said end thereof.

5. The screwdriver as claimed in claim 1, wherein said engaging piece has a recess at a bottom thereof and a spring is mounted within said recess to provide elastic movement of said engaging piece with respect to said sealing cover.

6. The screwdriver as claimed in claim 1, wherein said engaging piece has a groove at a top thereof, and said sealing cover is provided with a plurality of holes each receiving a ball adjacent to a top end thereof, each said ball being movable in a respective hole to bear against said groove.

7. The screwdriver as claimed in claim 6, wherein said groove in said engaging piece is arch-shaped.

8. The screwdriver as claimed in claim 6, wherein each said ball is slightly larger than the depth of each of said holes.

9. The screwdriver as claimed in claim 1, wherein said arcuating rod has an end projecting from said hollow sealing cover and includes a pressing block at said end.

10. The screwdriver as claimed in claim 9, wherein said actuating rod has a circular groove at a position near said pressing block.

11. The screwdriver as claimed in claim 1, wherein said hollow cylinder and a bottom of said sealing cover form a space therebetween for receiving said peg of said actuating rod.

12. The screwdriver as claimed in claim 1, wherein said hollow cylinder is provided with a channel between two guiding slots.

13. The screwdriver as claimed in claim 1, wherein said engaging piece is slidable on said

14. The screwdriver as claimed in claim 1, wherein said actuating rod is rotatable in said sealing cover to position said peg above a selected one of said connecting pieces so that when the actuating rod is pressed downwardly, the selected connecting piece will be lowered and the associated driver bit will travel through and protrude from said hole in the positioning head.

15. The screwdriver as claimed in claim 14, comprising spring means on each connecting piece engaging said hollow cylinder for opposing downward travel of said connecting piece and means between said actuating rod, said engaging piece and said sealing cover for locking said actuating rod in a downwardly lowered position in which the selected driver bit protrudes from said positioning head.

* * * * *